US006691390B2

(12) United States Patent
Arvin

(10) Patent No.: US 6,691,390 B2
(45) **Date of Patent: *Feb. 17, 2004**

(54) TUB/SHOWER VALVE ASSEMBLY WORKSTATION

(75) Inventor: Jerome M. Arvin, Springville, IN (US)

(73) Assignee: Plumbing 2000, Inc., Springville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/301,936

(22) Filed: Nov. 22, 2002

(65) Prior Publication Data

US 2003/0101560 A1 Jun. 5, 2003

Related U.S. Application Data

(62) Division of application No. 09/522,518, filed on Mar. 10, 2000, now Pat. No. 6,484,378.

(51) Int. Cl.[7] ..... B25B 27/14

(52) U.S. Cl. ..... 29/281.5; 29/281.1; 29/281.5; 269/289 R; 269/71

(58) Field of Search ..... 29/281.5, 281.1, 29/559, 335, 535; 269/289 R, 71, 73, 69, 68, 296, 285

(56) References Cited

U.S. PATENT DOCUMENTS

| | | | | |
|---|---|---|---|---|
| 98,361 | A | 12/1869 | Ellis | |
| 424,879 | A | 4/1890 | Golder | |
| 1,902,424 | A | 3/1933 | Sherman | |
| 2,904,087 | A | 9/1959 | Walthall | |
| 3,086,767 | A | 4/1963 | Boser | |
| 3,643,935 | A | 2/1972 | Bell | |
| 4,943,040 | A | 7/1990 | Finstad | |
| 5,082,038 | A | 1/1992 | Teel | |
| 6,484,378 | B1 * | 11/2002 | Arvin | 29/281.5 |
| 2003/0121136 | A1 * | 7/2003 | Arvin | 29/281.5 |

* cited by examiner

*Primary Examiner*—Lee D. Wilson
(74) *Attorney, Agent, or Firm*—Jay G. Taylor; Michael A. Swift; Ice Miller

(57) ABSTRACT

A portable tub/shower valve assembly workstation used to assemble tub/shower valve assemblies having a frame, a template, the template arranged and constructed to support at least one tub/shower valve, the template being pivotally carried on the frame for 360° rotation about a horizontal axis, whereby when the template is at a first angular position, the at least one tub/shower valve can be mounted and temporarily secured on the template, and when the template is rotated about the horizontal axis from a first angular position to a second angular position, the at least one tub/shower valve is retained on the template.

12 Claims, 17 Drawing Sheets

TUB/SHOWER VALVE ASSEMBLY WORKSTATION

This application is a divisional of application Ser. No. 09/522,518, filed on Mar. 10, 2000 now U.S. Pat. No. 6,484,378.

BACKGROUND

This invention relates to portable work stands in particular to a plumbing workstation having a plurality of interchangeable pivotal support templates. The templates are suitable for receiving specified sinks for installation of plumbing fixtures or suitable for assembling multiple tub/shower valve assemblies.

The traditional method of installing a sink is to first place the sink into the counter top opening, then proceed to attach various fixtures such as faucets, basket strainers, spray hose, garbage disposals and supply lines. Of course, the number and type of fixtures depends on the type of sink being installed. To do this, the installer must manipulate his body under the counter top, usually inside the cabinet or on the floor in an awkward position, holding fixture with one hand and using the other to operate hand tools. This is a time consuming process and one which often can lead to back strain because of the awkward position that the plumber must assume when installing plumbing fixtures on the sink in this traditional manner. Lost time injuries resulting from the traditional method of installing sinks are common and costly to the plumbing industry.

In the case of tub/shower valve assemblies, a plumber traditionally assembles each unit on the floor of the job site or on a workbench at the job site. The shower head pipe is typically inserted into the tub/shower valve. The plumber must arrange the tub/shower valve and shower head pipe to ensure that the head pipe is perpendicular to the tub/shower valve prior to soldering. This can be tricky because the shower head pipe is several feet long. Once the head pipe has been soldered in place, the plumber must wait until the solder joint has cooled enough to establish a viable connection before attempting to solder the shorter tub head pipe. The procedure is relatively time consuming as only one tub/shower valve assembly can be constructed at a time. Further, the tub/shower valve—shower head pipe joint frequently leaks and/or the shower head pipe is not essentially perpendicular, which can create installation problems and typically requires resoldering of the joint.

The deficiencies of the traditional approach to trimming-out and installing sinks and tub/shower valve assemblies are magnified in the case of multiple unit structures such as hotels and apartment buildings. Instead of two or three sinks and tub/shower valve assemblies as in a typically single family dwelling, the hotel or apartment building presents the plumber with up to hundreds of sinks and tub/shower valves to be trimmed out and installed. The likelihood of back strain and lost time injury increases dramatically. Further, the inefficiencies of the process are magnified. Every extra minute taken to assemble sinks or tub/shower valve assemblies on big projects is money out of the plumber's pocket as those types of jobs are typically bid on a fixed costs basis. Stated differently, the plumber gets paid a set fee for the job no matter how long it takes to complete.

Thus, the traditional approach to trimming-out sinks and tub/shower valve assemblies is inefficient, time consuming and, therefore, costly. Trimming-out sinks is awkward and frequently results in back strain and lost time injuries. Therefore, there is a desperate need in the plumbing industry for a device and method that will overcome the deficiencies associated with the traditional approach to assembling sinks and tub/shower valve assemblies. This is especially true for plumbing jobs involving multiple unit facilities such as hotels and apartment buildings.

SUMMARY

In accordance with the present invention, a plumbing workstation is provided which solves the deficiencies inherent in traditional approaches to trimming-out sinks and tub/shower valves. The plumbing workstation reduces the time and therefore cost associated with assembling tub/shower assemblies and installing plumbing fixtures such as faucets, pop-up assemblies, spray assemblies, garbage disposals, drain assemblies and basket strainers onto sinks prior to installation of the sinks into counter tops in kitchens, bathrooms and bars. The invention is particularly effective in reducing time and cost in the case of multiple unit facilities such as hotels and apartment buildings. Additionally, the plumbing workstation allows the worker to install the plumbing fixtures from an upright comfortable position thereby eliminating back strain and other muscle strains common to the traditional method of installing plumbing fixtures on a sink.

In accordance with the present invention, the plumbing workstation includes a frame and a means for supporting a sink. The supporting means is carried on the frame for rotation about a horizontal axis. The plumbing workstation further includes a means for locking the supporting means relative to the frame at selected angular positions about the horizontal axis. A means for securing the sink on the supporting means is provided such that when the sink is secured on the supporting means, the supporting means is a first angular position and when the supporting means is rotated about the horizontal axis from the first angular position to a second angular position, the sink is retained on the supporting means to facilitate installation of plumbing fixtures on the sink. The supporting means is carried on the frame and is rotatable over 360 degrees about the horizontal axis.

The plumbing workstation further comprises a second supporting means. The second supporting means is interchangeable with the supporting means for installation on the frame and is pivotally carried on the frame for rotation about the horizontal axis. The second supporting means is arranged and constructed to support more than one sink.

The plumbing workstation further comprises a third supporting means that is interchangeable with the supporting means for installation on the frame. The third supporting means is pivotally carried on the frame for rotation about the horizontal axis. The third supporting means having means for mounting one or more tub/shower valves such that a worker can assemble one or more tub/shower valve assemblies.

The plumbing workstation further comprising means for retaining sink drain attachments. The sink drain attachment retaining means is mounted on the supporting means such that when the supporting means is rotated to the second angular position, the sink drain attachment retaining means holds sink drain attachments in place while the worker applies pressure to install the sink drain attachments. If the second supporting means is being utilized, then the plumbing workstation further comprises more than one sink drain attachment retaining means. The more than one sink drain attachment retaining means is mounted on the second supporting means such that when the second supporting means is rotated to the second angular position, the more than one sink drain attachment retaining means holds sink drain attachments in place on more than one sink while the worker applies pressure to install the sink drain attachments on the more than one sink.

The plumbing workstation further comprising a frame that includes means for vertically adjusting the position of the horizontal axis so that the horizontal axis can be adjusted by the worker to a height such that the worker can comfortably install plumbing fixtures. The frame may further comprise means for collapsing the frame thereby allowing the plumbing workstation to be easily transported and stored.

According to another embodiment of the present invention, a method for installing plumbing fixtures on a sink using a plumbing workstation comprises the steps of: choosing a template such that the template chosen is suitable for supporting a first sink to be worked on; installing the template onto a frame; locking the template into a horizontal position on the frame; placing the first sink into the template; securing the first sink into the template; temporarily retaining the plumbing fixtures onto the sink; rotating the template about a horizontal axis into a comfortable working position; locking the template into the comfortable working position; and installing a plumbing fixture onto the first sink.

According to another embodiment of the present invention, a method for installing plumbing fixtures on multiple sinks using a plumbing workstation comprises the steps: choosing a template such that the template chosen is suitable for supporting more than one sink to be worked on; installing the template onto a frame; locking the template into a horizontal position on the frame; placing the more than one sink into the template; securing the more than one sink into the template; rotating the template about a horizontal axis into a comfortable working position; locking the template into the comfortable working position; installing plumbing fixtures onto the more than one sink; rotating the template back to the horizontal position; locking the template into the horizontal position; unsecuring the more than one sink from the template; and removing the fully assembled more than one sink from the template.

According to yet another embodiment of the present invention, a method of using a plumbing workstation to assemble tub/shower valve assemblies comprises the steps: choosing a template such that the template chosen is suitable for assembling one or more tub/shower valve assemblies; installing the template onto a frame; locking the template into a horizontal position on the frame; mounting one or more tub/shower valves onto the template; inserting shower head pipes into the one or more tub/shower valves; inserting tub head pipes into the one or more tub/shower valves; soldering the showering head pipes and tub head pipes into the one or more tub/shower valves to complete assembly of the one or more tub/shower valve assemblies; and removing the one or more tub/shower valve assemblies from the template.

Use of the present invention results in significant reduction of trim-out time resulting in a corresponding cost savings. The invention is particularly suitable for large plumbing jobs involving multiple units, for example, hotels and apartment buildings. Additionally, the present invention eliminates uncomfortable body positions during the installation of various plumbing fixtures, thereby eliminating muscle strains, back problems, and associated lost productivity and time off.

These and other advantages and features of the present invention shall hereinafter appear, and for the purposes of illustration, but not limitation, exemplary embodiments of the present invention shall hereinafter be described.

BRIEF DESCRIPTION OF THE DRAWINGS

FIG. 16A is an the exploded view of an alternate embodiment of a sink retainer.

FIG. 17A is an exploded view of the alternate frame's height adjustment feature.

DETAILED DESCRIPTION

Structure

Figure 1:
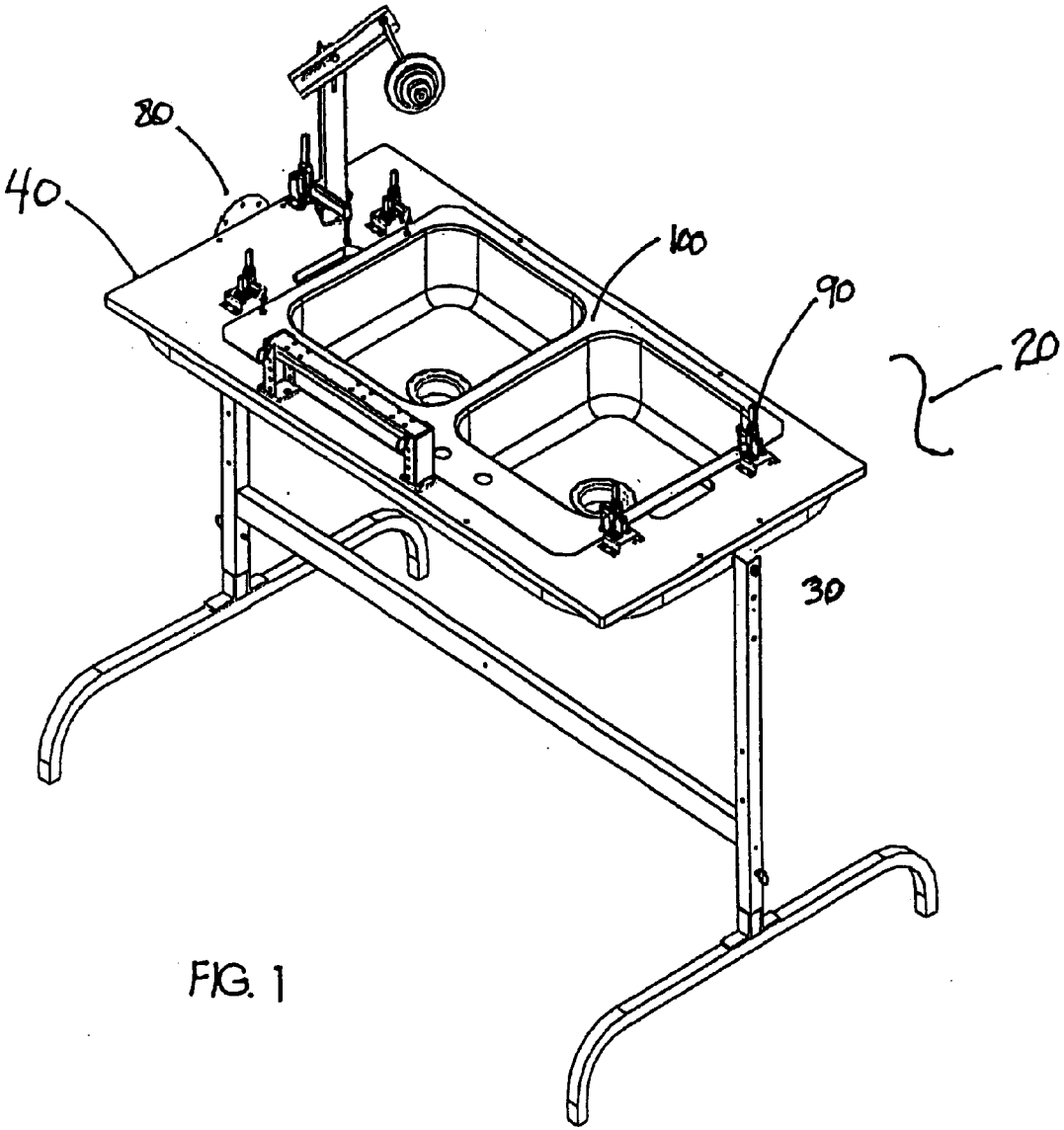
FIG. 1 is a perspective view of the plumbing workstation with an unibody double sink installed on the template.
Figure 2:
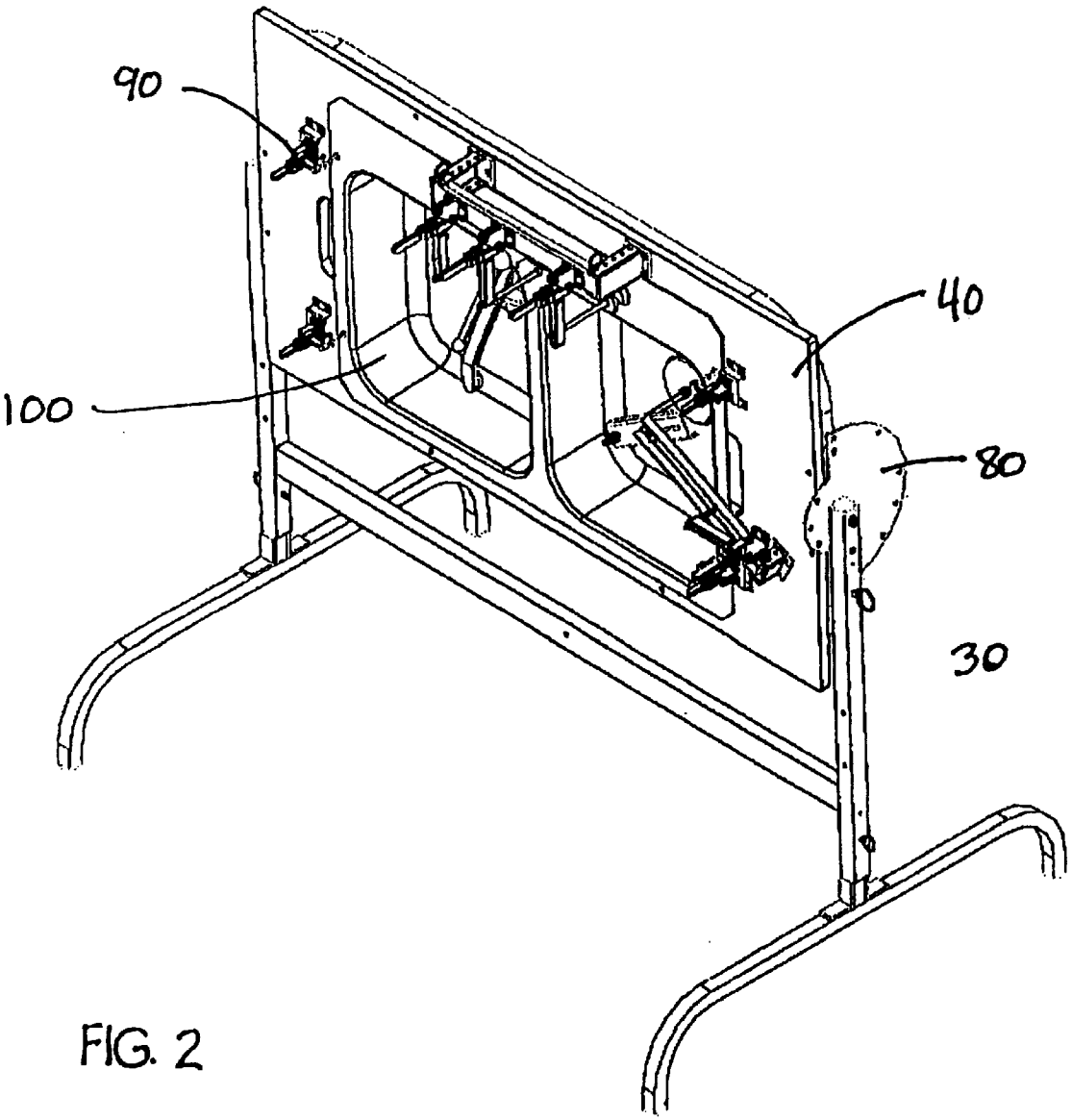
FIG. 2 is a perspective view of the plumbing workstation of FIG. 1 wherein the template is rotated 90 degrees about the horizontal axis.

In accordance with the present invention, a plumbing trim-out workstation is provided as shown in FIG. 1, FIG. 2, FIG. 3 and FIG. 10 and is generally indicated by the numeral 20. The plumbing trim-out workstation 20 includes a frame 30, and interchangeable template 40 for supporting a sink unit 100 that is pivotally carried on the frame 30 and is rotatable 360° about a horizontal axis 70 relative to the frame 30 (see FIG. 4.), a releaseable lock 80 mounted to the frame 30 for locking the template 40, 50, 60 relative to the frame 30 at selected angular positions about the horizontal axis 70, and at least one sink retainer 90 for securing a sink or multiple sinks on the template such that when the sink is on the template and secured by the sink retainer, the sink will be retained on the template as the template is rotated about the horizontal axis 70. A template 40, 50, 55, 60 when mounted on frame 30 is rotatable over 360° about the horizontal axis 70.

Figure 3:
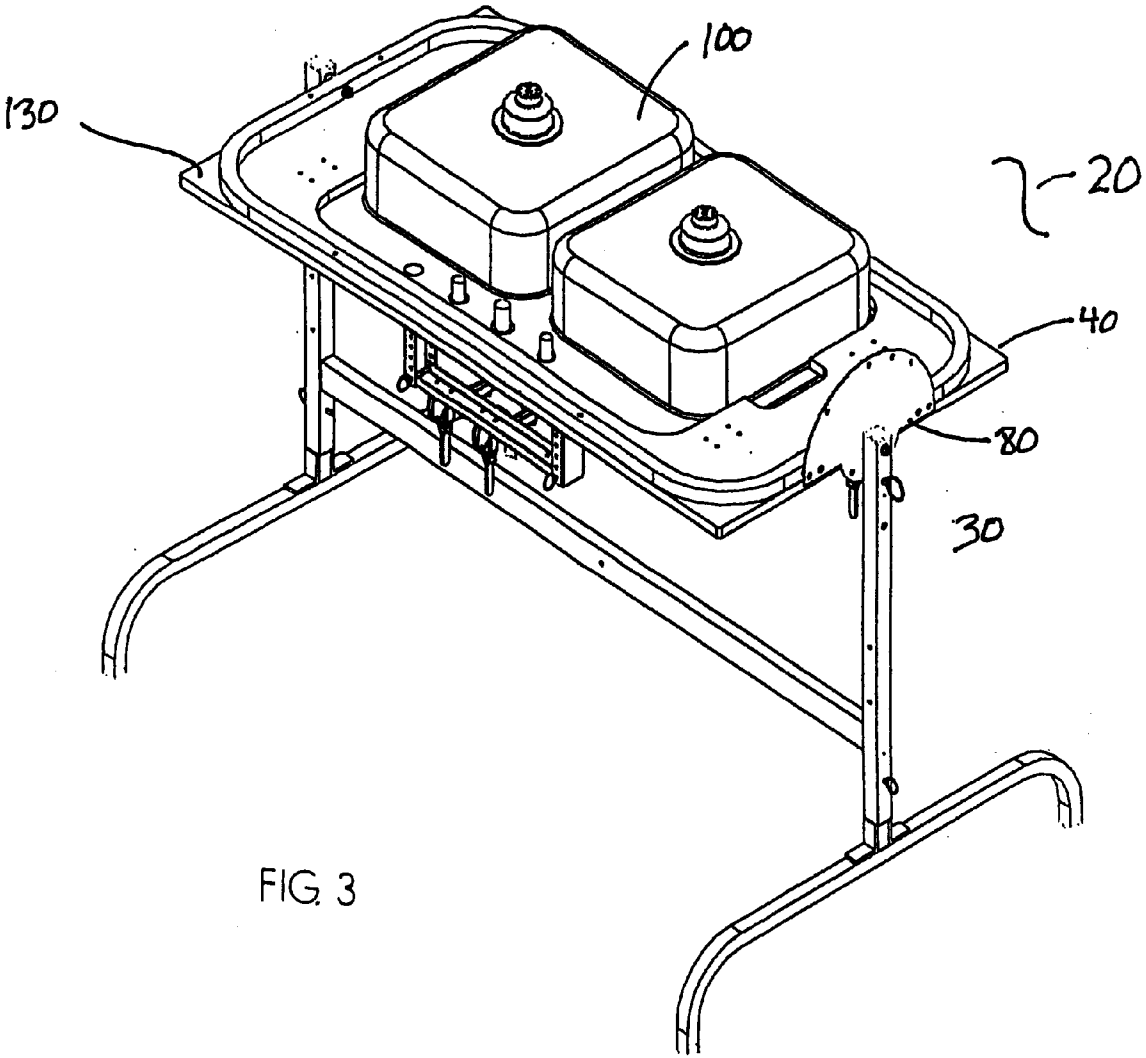
FIG. 3 is a perspective view of the plumbing workstation of FIG. 1 wherein the template is rotated 180 degrees about the horizontal axis.

The template 40 shown in FIG. 1, FIG. 2, FIG. 3, and FIG. 8 is constructed to support a single rectangular sink or a single unit formed into a multiple sink configuration (100). A sink 100 is passed through opening 110 from the top side 120 of the support template 40. The sink flange rests on the top side 120 of the support template 40. Referring to FIG. 1 and FIG. 3, as the sink flange rests on the top side 120, openings for plumbing fixtures, such as faucets, located in the flange of the sink are accessible from both the top side 120 and bottom side 130 of the template 40. As can be readily seen in FIG. 8, FIG. 10, and FIG. 11 a bridge or bridges 42 in combination with multiple toggle clamps are used to temporarily retain plumbing fixtures in place on a sink or sinks prior to installation of the fixtures onto the sink or sinks.

Figure 10:
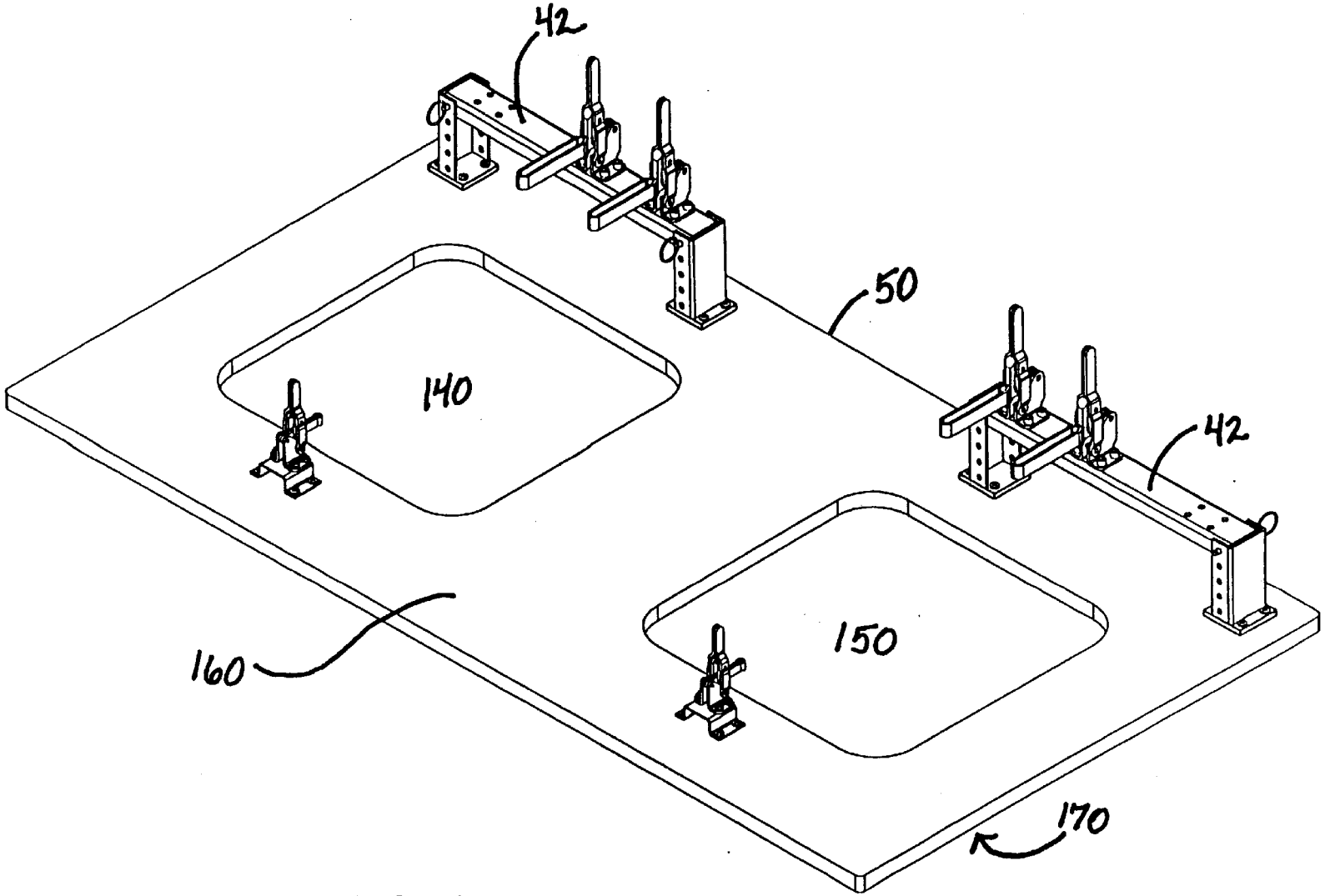
FIG. 10 is a perspective view of a second template for supporting two rectangular sinks.
Figure 11:
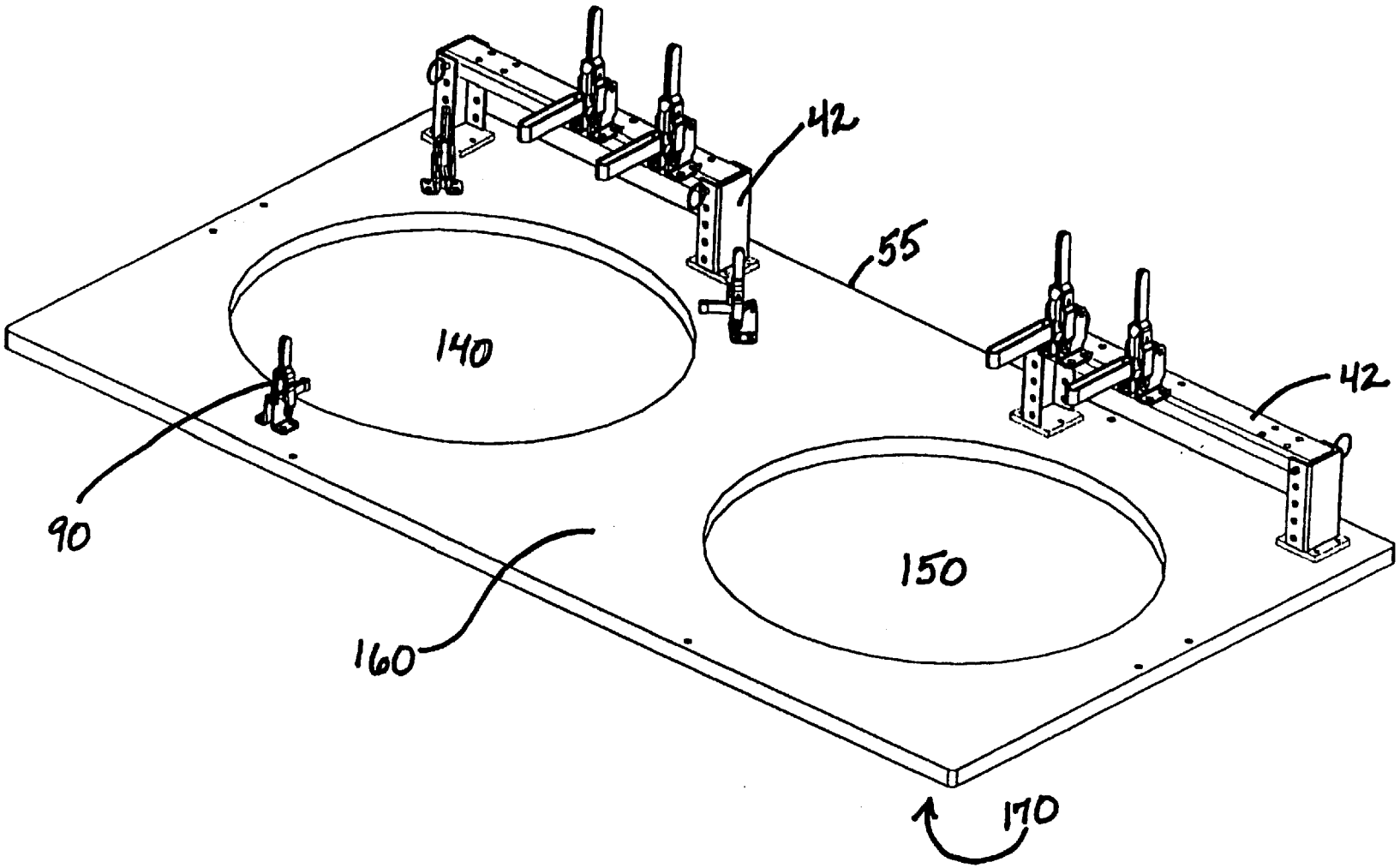
FIG. 11 is a perspective view of an alternate second template constructed to support two round or oval sinks.

A second template 50 shown in FIG. 10 is configured to support two rectangular. FIG. 11 shows an alternate embodiment 55 of the second template arranged and configured to support two round or oval sinks. The second template 50 is interchangeable with the template 40 for mounting on frame 30. The second template is pivotally carried on the frame for 360° rotation about the horizontal axis 70. A first sink with a flange is passed through opening 140 from top side 160 of template 50. A second sink is passed through opening 150 from top side 160. The flanges of the two sinks rest on top side 160 of template 50. As the two sink flanges rest on top side 160, openings for plumbing fixtures such as faucets located in the flanges of the sinks are accessible from both top side 160 and bottom side 170 of template 50.

Figure 12:
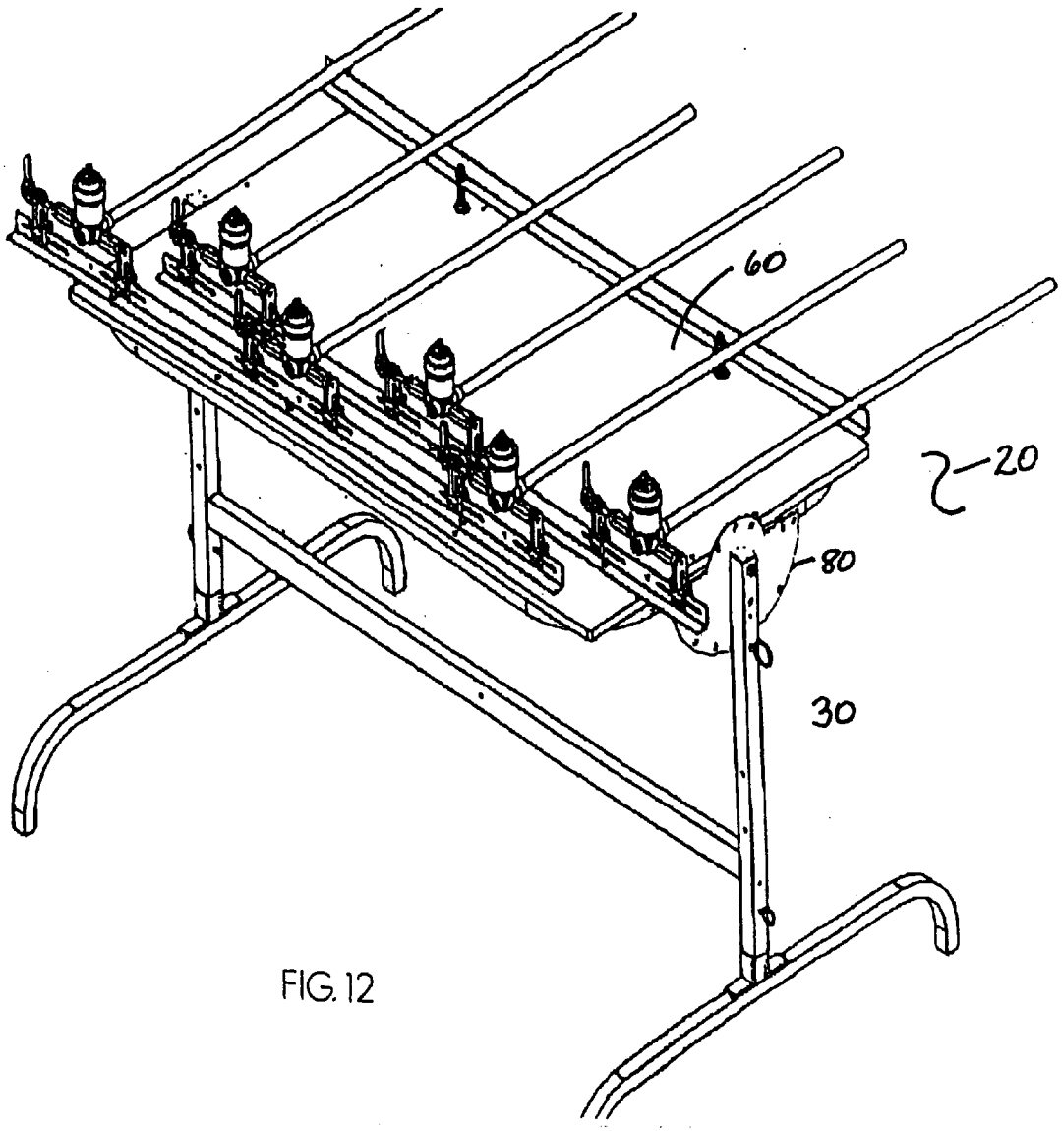
FIG. 12 is a perspective view of the plumbing workstation with a third template for use in assembling tub/shower valve assemblies.
Figure 13:
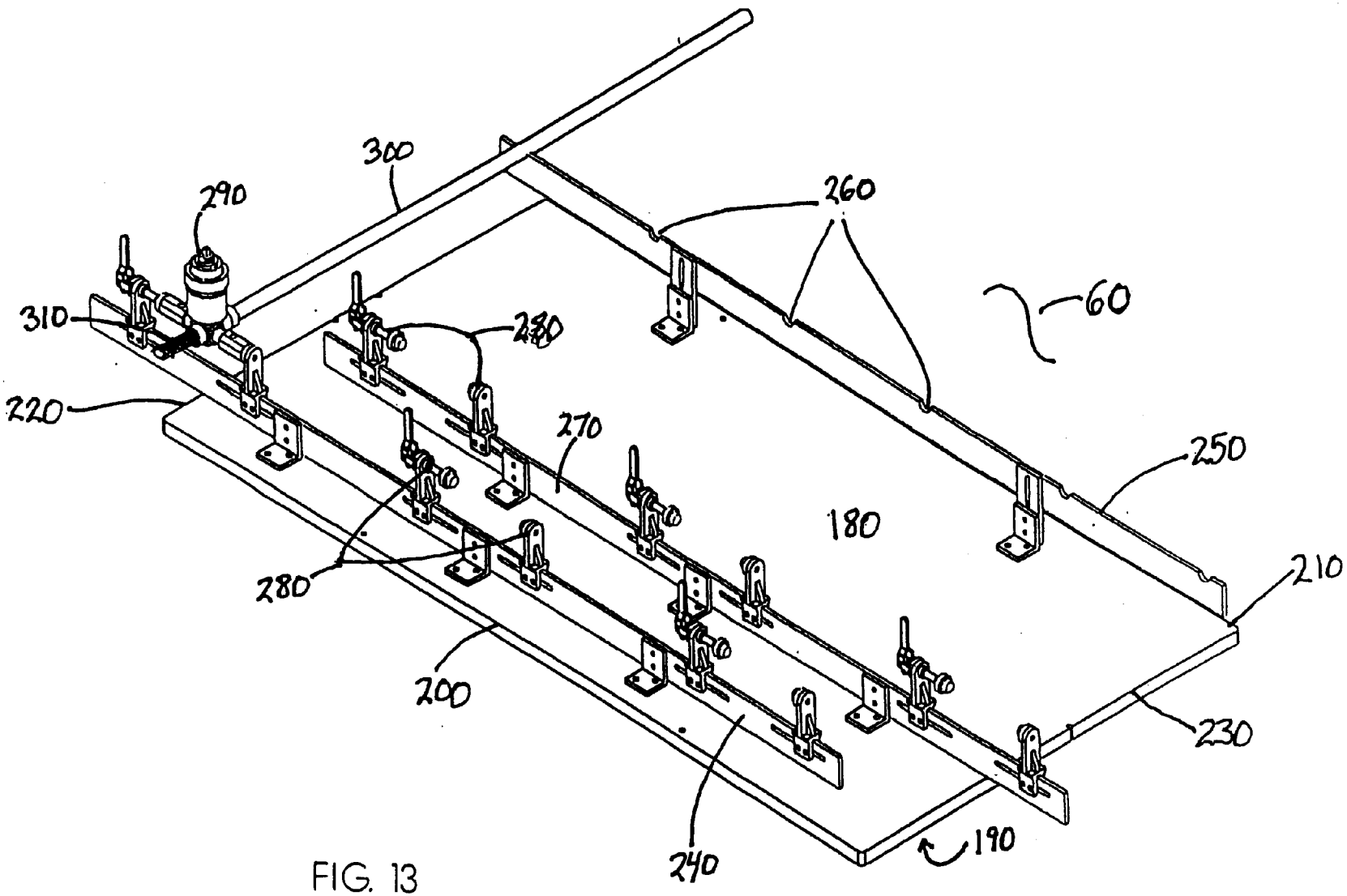
FIG. 13 is a perspective view of the third template for use in assembling tub/shower valve assemblies.

As depicted in FIG. 12 and FIG. 13, the plumbing workstation further comprises a third template 60 configured to allow efficient assembly of tub/shower valve assemblies. The third template 60 is interchangeable with template 40 for mounting on frame 30. The third template is pivotally carried on frame 30 for 360° rotation about the horizontal axis 70. Referring more specifically to FIG. 13, the third template 60 includes a top side 180, a bottom side 190, a first edge 200, a second edge 210 opposite and parallel to the first edge, a third edge 220, a fourth edge 230 opposite and parallel to the third edge, the third and fourth edges perpendicular to the first and second edges, a first bar 240 mounted on the top side 180, the first bar 240 in close proximity and parallel to the first edge 200, a second bar 250 adjustably mounted on the top side, the second bar in close proximity and parallel to the second edge 210, the second bar having one or more grooves 260, a third bar 270 mounted on the top side 180, the third bar parallel to an intermediate of the first bar 240 and second bar 250. The third template 60 further comprises one or more means for retaining 280 one or more tub/shower valves 290. The one or more tub/shower valve retaining means 280 are adjustably mounted on the first bar 240 and the third bar 270 such that when the one or more tub/shower valves 290 are mounted in the one or more tub/shower valve retaining means 280 and one or more shower head pipes 300 are inserted into the one or more tub/shower valves, the opposite end of the shower head pipes rests in groove 260. The second bar 250 may be adjusted upwardly or downwardly so that the shower head pipes inserted into the one or more tub/shower valves is perpendicular to said valves. The tub/shower valve retaining means 280 comprises more than one pair of arm brackets slidably mounted onto first bar 240 and third bar 270. Each pair of arm brackets hold a toggle clamp and a button. Because the arm brackets are slidably mounted onto first bar 240 and second bar 270, the position of the toggle clamps and buttons may be preadjusted to hold and secure different sizes of tub/shower valves manufactured by any particular manufacturers of said valves. The embodiment of the third template as depicted in FIG. 12 and FIG. 13 allows for assembling of up to six tub/shower valve assemblies at a time.

Figure 16:
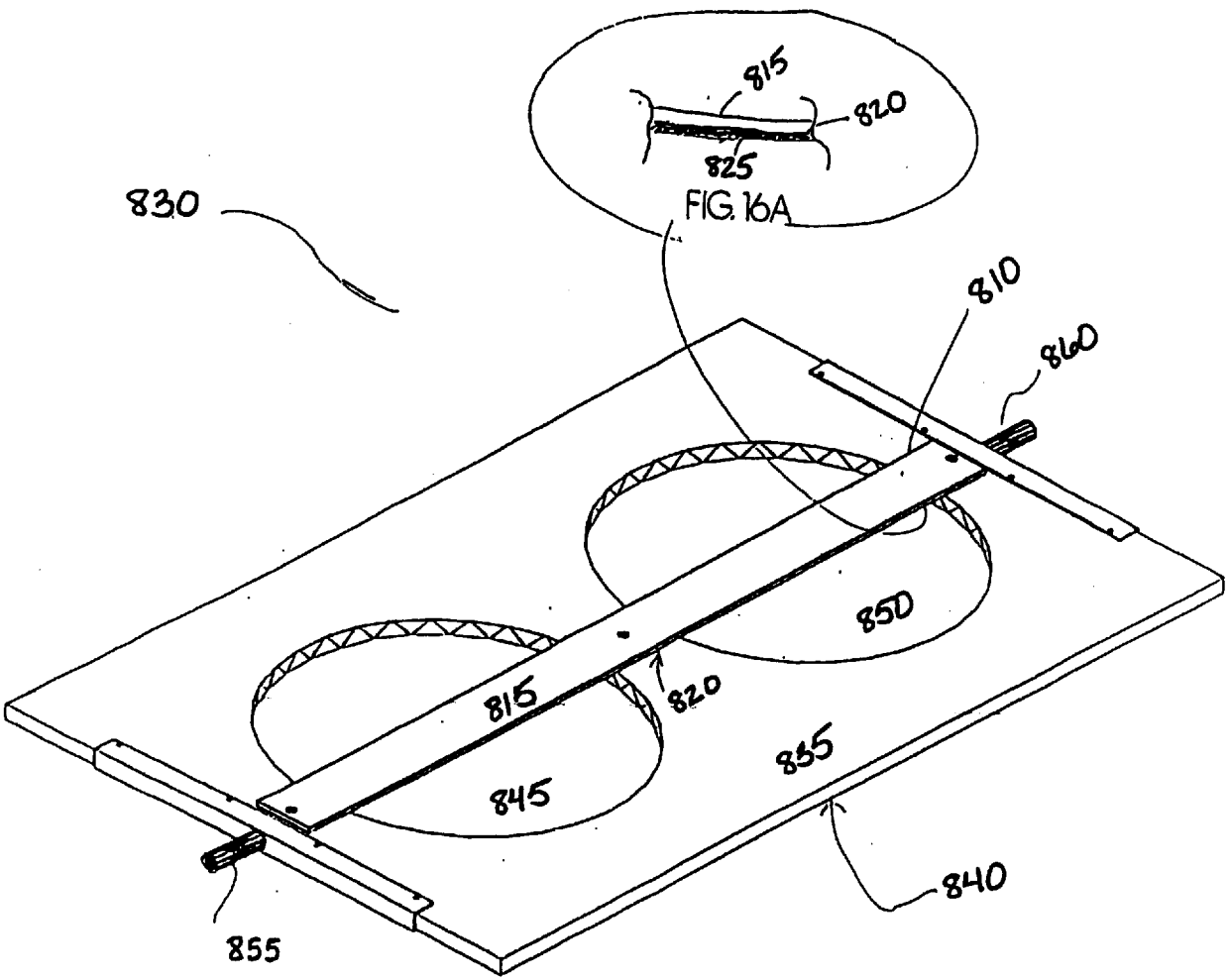
FIG. 16 is an alternate embodiment of a template with two openings that incorporates an alternate embodiment of the sink retainer.

The sink retainer 90 comprises a toggle clamp or equivalent thereof as is well-known in the art. One or more toggle clamps may be used to retain single or multiple sinks as appropriate. An alternate embodiment of the sink retainer is depicted in FIG. 16 and FIG. 16A. This alternate embodiment of the sink retainer 810 comprises a bar with a top side 815 and a bottom side 820. The bar is removably attached to either the template or the second template such that the bottom side of the bar is in contact with the sink and the template thereby trapping the sink into the template. The sink retainer 810 further comprises a protective cushion 825 on the bottom side of the bar wherein the protective cushion is at least one material chosen from rubber, teflon, plastic, fiber, foam rubber and any combination thereof.

The plumbing workstation further includes at least one means for retaining sink drain attachments. The sink drain attachment retaining means holds sink drain attachments such as garbage disposals, basket drainers, and pop-up drain assembles firmly in place while the sink and template are rotated from a horizontal angular position to a second angular position about the horizontal axis and the worker applies pressure to install the attachments on the sink. The sink drain attachment retainer may be used in conjunction with any template.

Figure 8:
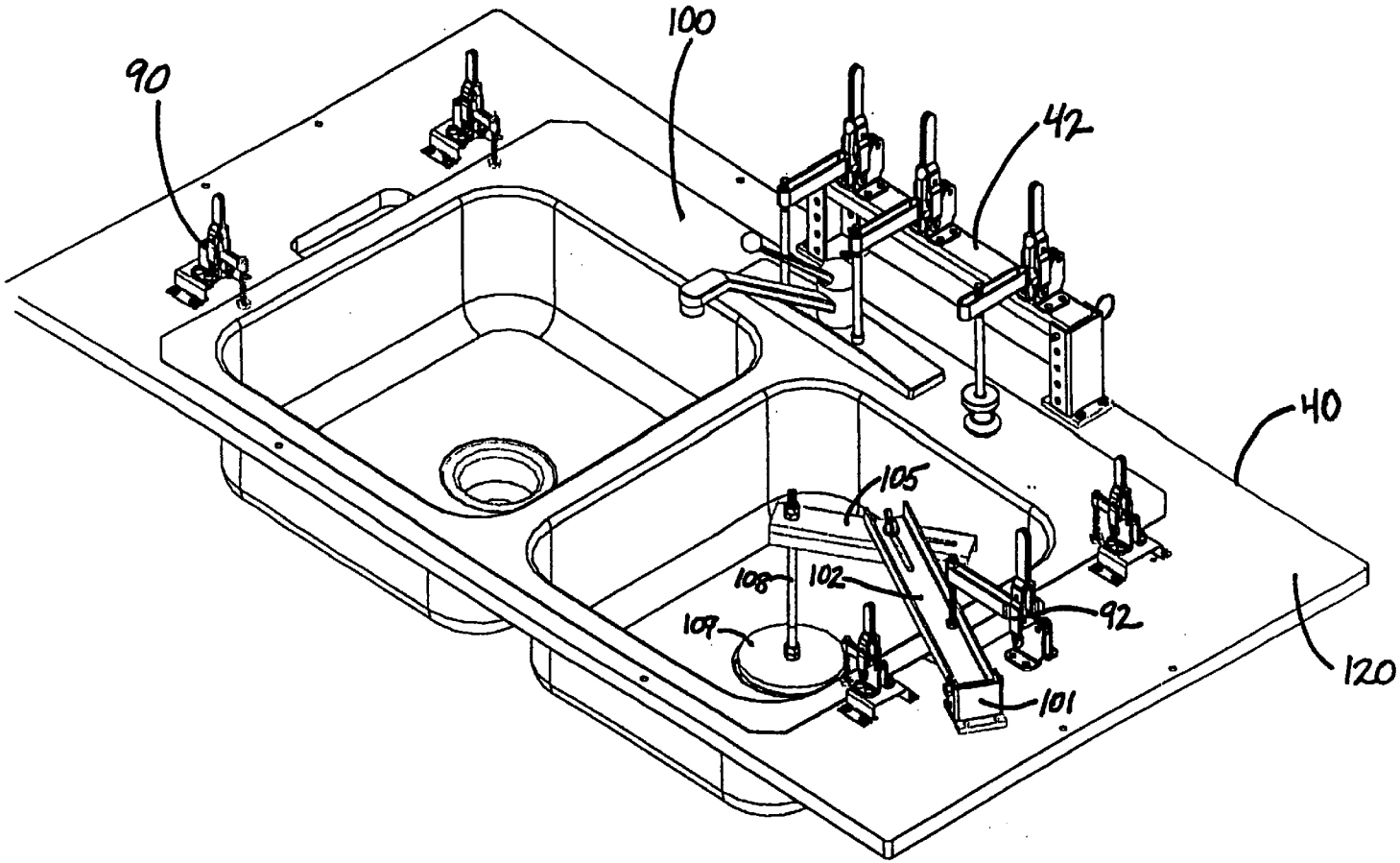
FIG. 8 is a perspective view of the template of FIG. 7 with a unibody double sink installed on the template.
Figure 9:
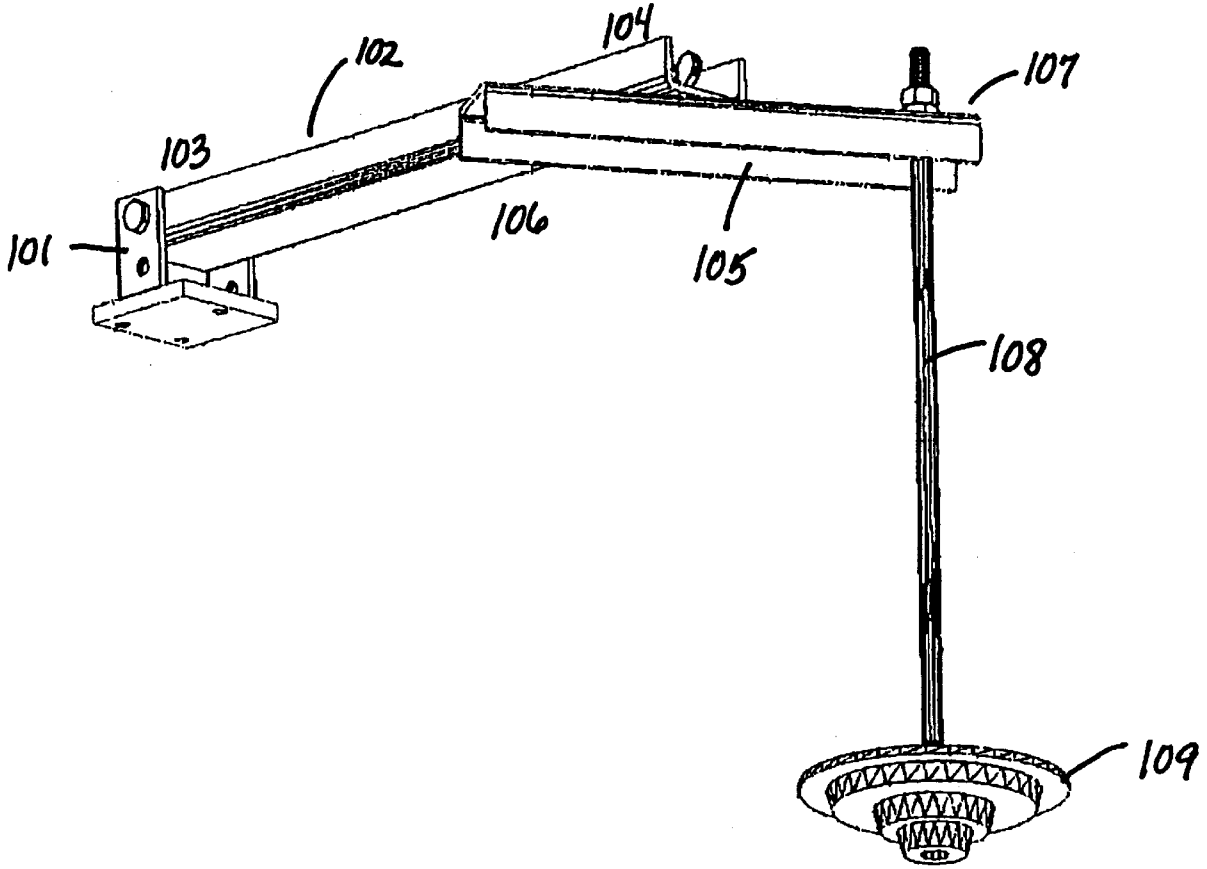
FIG. 9 is a perspective view of the sink drain attachment retainer.

As illustrated in FIG. 1, FIG. 8 with sink 100 installed on template 40, and FIG. 9, the sink drain attachment retainer comprises a bracket 101 mounted on topside 120 of template 40, a first horizontal member 102 having a first end 103 and a second end 104. The first horizontal member 102 is pivotally attached to bracket 101 in close proximity to first end 103 and extends horizontally from topside 120 over sink 100. The sink drain attachment retainer further comprises a second horizontal member 105 having a first end 106 and a second end 107. The second horizontal member 105 is slidably attached to the first horizontal member 102 in close proximity to first horizontal member's second end 104 and second horizontal member's first end 106. The second horizontal member 105 extends horizontally over sink 100 from first horizontal member 102. The sink drain attachment retainer further comprises a vertical member 108 with a proximal end and a distal end. The vertical member's proximal end is attached to the second horizontal member in close proximity to second end 107 and extends downwardly therefrom. Attached to the distal end of the vertical member 108 is stopper element 109 comprising multiple concentric elements of various diameters all extending perpendicularly from vertical member 108 as depicted in FIG. 9.

In operation, the first horizontal member 102 and second horizontal member 105 are manipulated to position stopper 109 over a sink drain. Stopper 109 then is lowered until it contacts the sink drain attachment being installed. Referring specifically to FIG. 8, toggle clamp 92 is actuated against the top of first horizontal element 102, thereby locking the sink drain attachment retainer in position and securing the drain attachment such that when the template and sink are rotated about the horizontal axis and secured in a second angular position, a worker can install the sink drain attachment.

Figure 4:
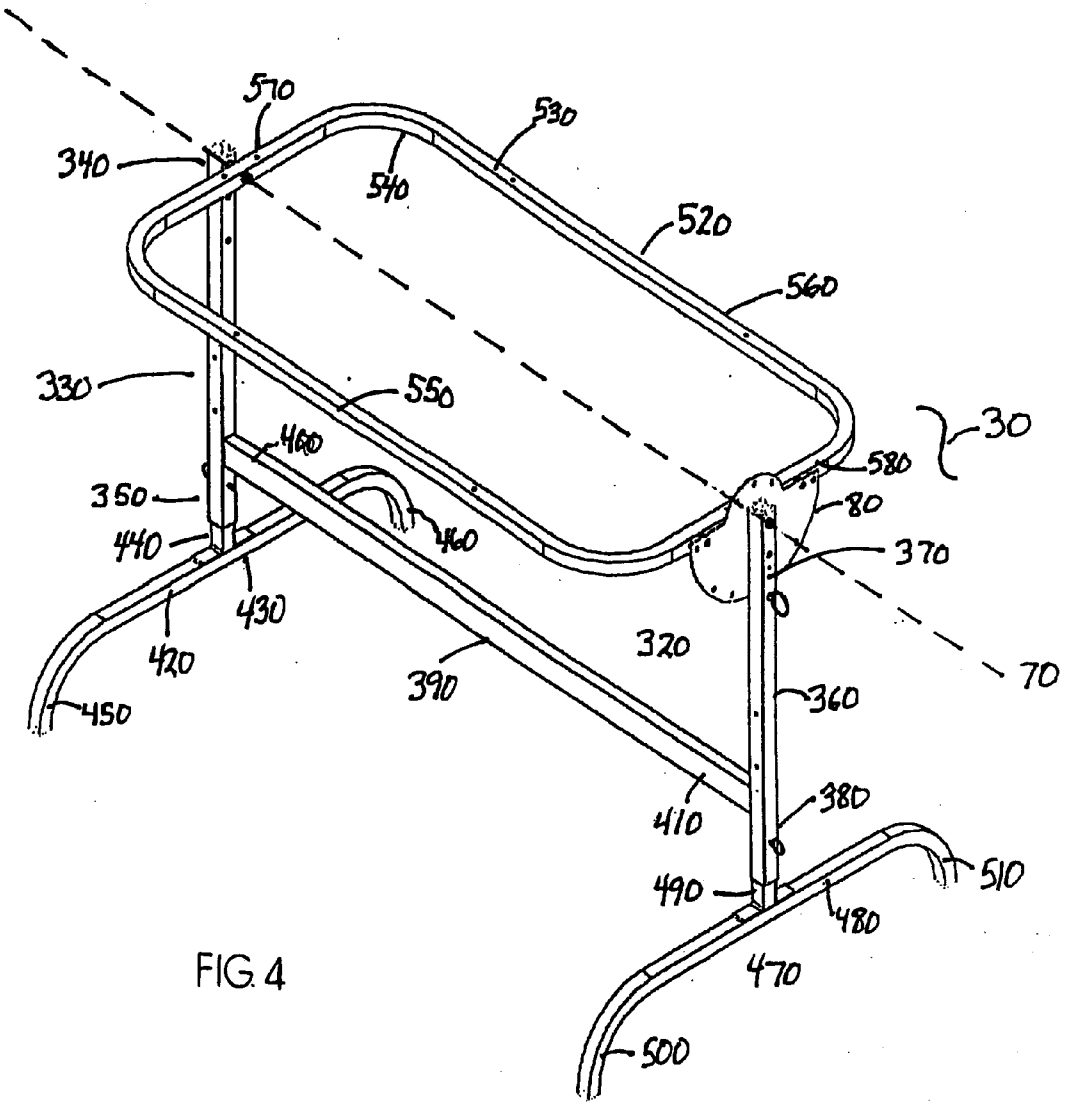
FIG. 4 is a perspective view of the frame.

Referring to FIG. 4, the frame of the preferred embodiment comprises an H member 320 having a first vertical tube 330 and a second vertical tube 360 and a horizontal tube 390. The first vertical tube has a proximal end 340 and a distal end 350. The proximal end 340 has at least two holes there through, the at least two holes having center lines perpendicular to the first vertical tube and parallel to the horizontal axis 70. The distal end 350 of the first vertical tube 330 has at least one hole there through. The second vertical tube 360 has a proximal end 370 and a distal end 380. The proximal end 370 of the second vertical tube 360 has at least two holes there through which have center lines perpendicular to the second vertical tube 360 and parallel to the horizontal axis 70. The distal end 380 has at least one hole there through. The horizontal tube 390 has first end 400 and a second end 410. The first end 400 is fixedly attached to the first vertical tube 330 intermediate of the first vertical tube's proximal and distal ends. The second end 410 of the horizontal tube 390 is fixedly to the second vertical tube 360 intermediate of the second vertical tube's proximal and distal ends. The frame further comprises a first foot member 420 having a horizontal member 430 and a vertical member 440. The horizontal member 430 has a first end 450 and a second end 460. The vertical member 440 is fixedly attached to the horizontal member 430 intermediate of the horizontal member's first and second ends. The vertical member 440 extends upwardly and perpendicularly from the horizontal member 430. The vertical member 440 has at least one hole there through and is constructed to slide into the distal end 350 of the H member's first vertical tube 330. When the first vertical member's at least one hole and the first vertical tube distal end's at least one hole are aligned, a pin may be inserted there through, thereby locking together the first vertical tube 330 and the vertical member 440 such that the first foot member's horizontal member 430 is perpendicular to the horizontal axis 70. The frame further comprises a second foot member 470 having a horizontal member 480 and a vertical member 490. The horizontal member 480 having a first end 500 and a second end 510. The vertical member 490 is fixedly attached to the horizontal member 480 intermediate of the horizontal member's first 500 and second 510 ends. The vertical member extends upwardly and perpendicularly from the horizontal member and the vertical member 490 has at least one hole there through. The vertical member 490 is constructed to slide into the distal end 380 of the H member's second vertical tube 360. When the first vertical member's at least one hole and the second vertical tube's distal end at least one hole are aligned, a pin may be inserted there through thereby locking together the second vertical tube 360 and the vertical member 490 such that the horizontal member 480 is perpendicular the horizontal axis 70.

The frame 30 further comprises a template support 520 having a topside 530, a bottom side 540, a first edge 550, a second edge 560, a third edge 570, and a fourth edge 580. The first edge 550 is opposite and parallel to the second edge 560. The third edge 570 is opposite and parallel to the fourth edge 580. The third and fourth edges are perpendicular to the first and second edges. The third edge 570 is pivotally attached at its midpoint to the first vertical tubes proximal end 340. The fourth edge 580 is pivotally attached at its midpoint to the second vertical tubes proximal end 370.

Figure 5:
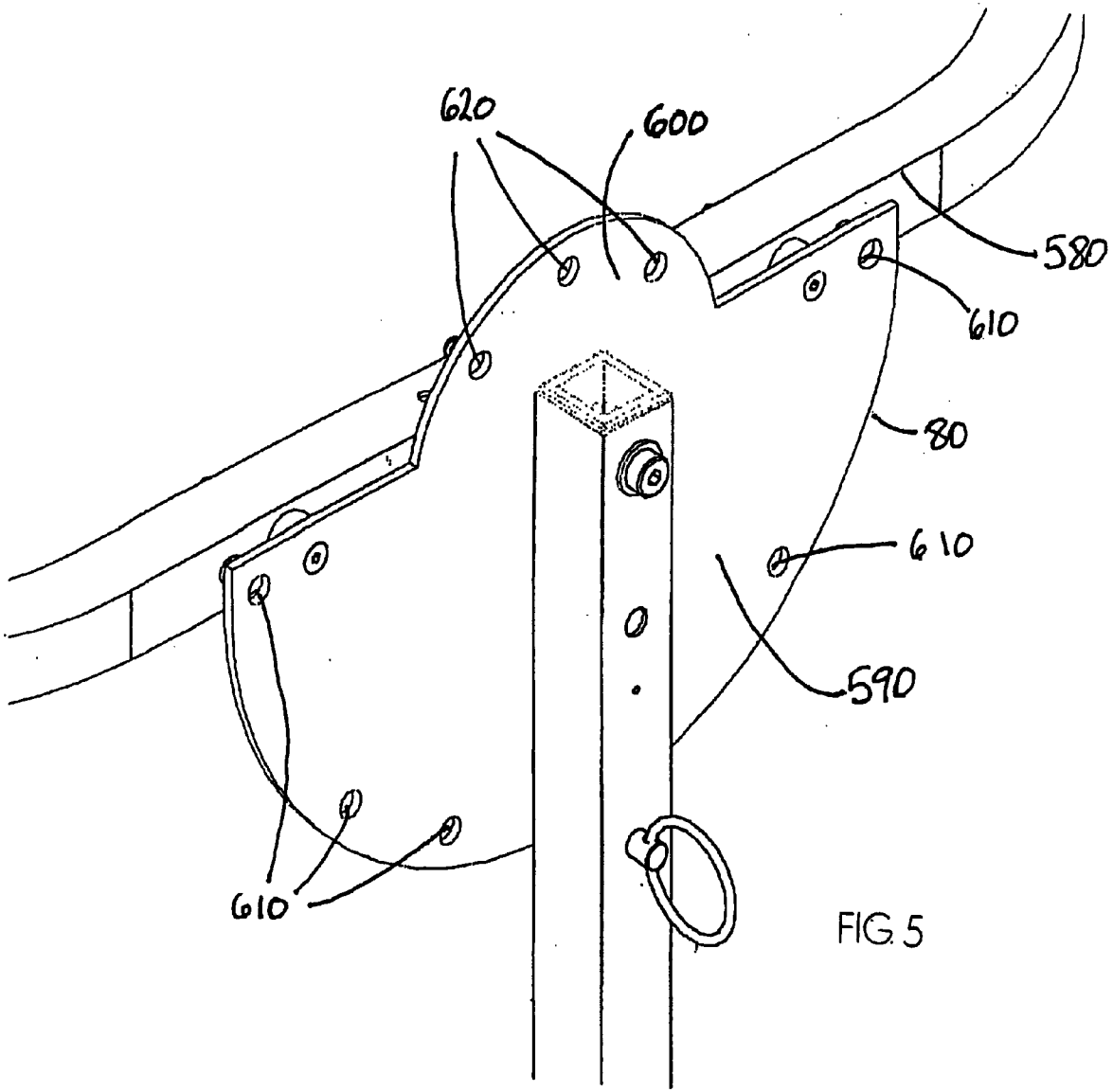
FIG. 5 is an exploded perspective view of the arc plate.

The frame 30 further comprises an arc plate 80 as shown in FIG. 1 through FIG. 5. Referring specifically to FIG. 5, the arc plate 80 is fixedly attached and horizontally centered on the template supports fourth edge 580 although, the arc plate may also be mounted on the template supports third edge as depicted in FIG. 1. Referring again to FIG. 5, the arc plate 80 comprises a shaped plate with a larger half circle 590 extending downwardly from the fourth edge 580. The arc plate 80 further comprises a smaller half circle 600 extending upwardly from the fourth edge 580. The larger half circle 590 includes a plurality of holes 610 arranged along its circumference. The smaller half circle 600 includes a plurality of holes 620 arranged along its circumference. When any of the holes on the larger or smaller half circles are aligned with the second vertical tubes proximal end holes, a pin may be inserted there through, thereby locking the template support in a specific angular position about the horizontal axis 70.

Figure 6:
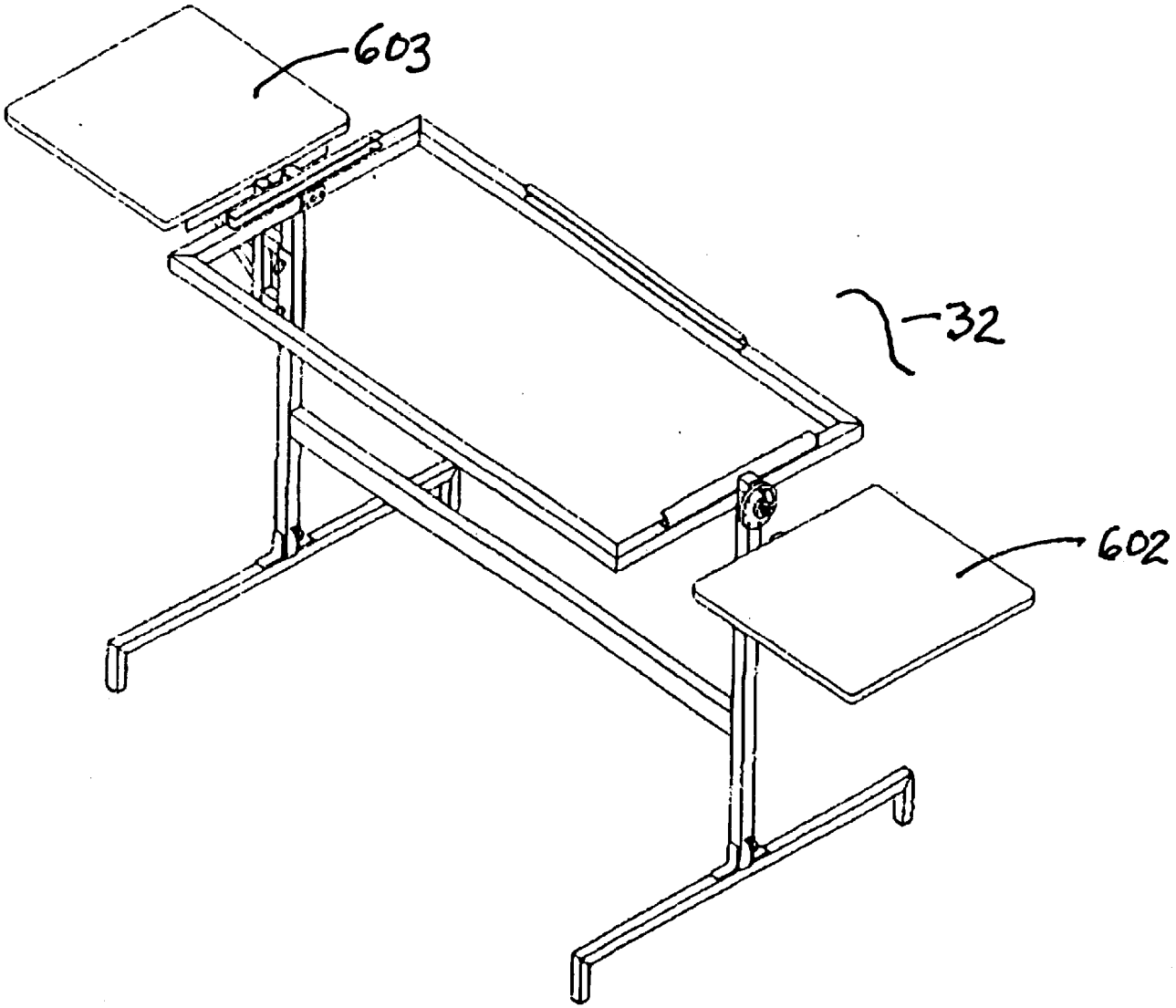
FIG. 6 is a perspective view of an alternate embodiment of the frame incorporating side tables.

Referring to FIG. 6, an alternate embodiment of the frame 32 is depicted. Frame 32 includes one or more side tables 602, 603 releasable attached to the frame 32. The side tables can be used by a worker to hold tools and other implements necessary to assemble sinks and/or tubs/showers valve assembles. The side tables 602, 603 may be incorporated in any embodiment of the frame.

Methods of Use

Figure 7:
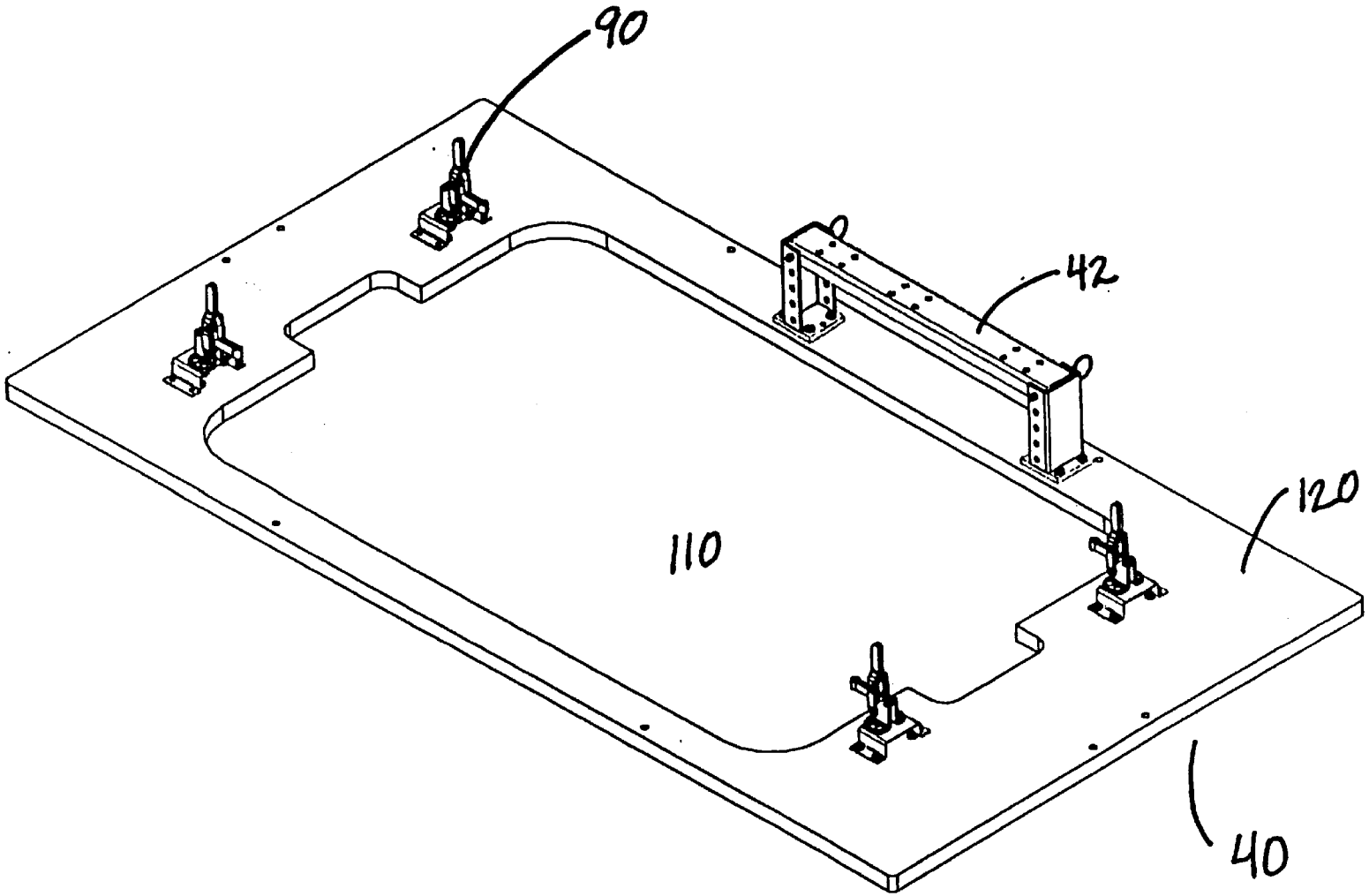
FIG. 7 is a perspective view of a template.

The plumbing workstation can be used at any job site where a sink or sinks or tub/shower valves will be installed. The most effective use of the plumbing workstation, however, occurs on jobs involving multiple units where many of the same type of sink or tub/shower valve assemblies will be installed, e.g., apartment buildings and hotels. Typically, the plumbing workstation is transported to a job site and set up. A template is chosen based upon the sink or sinks to be worked on. For instance, if a kitchen sink is the type to be installed, a template 40 similar to that depicted in FIG. 7 may be appropriate.

Once the appropriate template has been chosen, it is installed on the frame and typically locked into a roughly horizontal position via the releasable lock. The sink is inserted into the template 40 opening 110 from the top side 120 to the bottom side. The sink flange rests on the top side of the template and any openings in the flange suitable for receiving plumbing fixtures are accessible from both the top side and bottom side of the template. Next, the sink is secured into the template using at least one sink retainer 90. Alternately, any common device known in the art may be used to secure the sink.

Once the sink is secured in the template, the worker can place the fixtures on the sink, temporarily secure them, and then rotate the template to an appropriate angular position where final installation of the fixtures will be preformed. Alternatively, the worker can either install plumbing fixtures from the roughly horizontal position or unlock the template, rotate it with its retained sink to a more desirable angular position about the horizontal axis 70 and lock the template at that more desirable angular position. The worker can then select a plumbing fixture and install it on the sink while standing upright in a comfortable position. The remaining plumbing fixtures can then be installed. In the case of kitchen sinks, plumbing fixtures could include faucets, garbage disposals, spray assemblies, basket strainers, and soap dispensers.

Once all the plumbing fixtures are installed on the sink, the template is unlocked and rotated back to the roughly horizontal position. The sink is unsecured and removed from the template. The assembled sink is now ready to be placed into the counter top for quick connection of water supply lines and waste lines. The entire process is repeated until all the sinks requiring the chosen template are assembled.

If another size, type or number of sinks are also to be installed at the same job site, as is typically the case in apartment buildings where apartments will have a kitchen requiring one type of sink and at least one bathroom which requires a different type of sink or sinks, then the template used for the single sink as previously discussed is removed from the frame. In the case of twin round bathroom sinks, the appropriate template 55, as shown in FIG. 11, is chosen. The second template 50 is installed on the frame and locked into a roughly angular position. If the frame includes a height adjustment feature, the height can be set either before or after the template is installed on the frame.

Next, the two round sinks are installed on the template 55 through openings 140 and 150 from the top side 160 to the bottom side 170. The flanges of the sinks rest on the top side such that flange openings are accessible from both the top side and bottom side. The two round sinks are then secured in place using more than one sink retainer 90. The worker can temporarily service plumbing fixtures using the template's bridges and toggle clamps, rotate the template into a comfortable working angular position and lock it into place. The appropriate plumbing fixtures can be installed on the two sinks. In the case of twin bathroom sinks, the appropriate plumbing fixtures would generally comprise a faucet, drain assembly and pop up assembly for each sink.

In another embodiment, the plumbing workstation may also be used to assemble tub/shower valve assemblies. A template is chosen suitable for assembling one or more tub/shower valve assemblies such as template 60 as depicted in FIG. 13. Template 60 is installed onto the frame and locked into a roughly horizontal position on the frame. One or more tub/shower valves are mounted onto the template. Shower head pipes 300 are inserted into the tub/shower valves 290 and the second bar 250 is vertically adjusted such that the shower head pipe 300 is perpendicularly aligned with the tub/shower valve. Next, tub head pipes 310 are inserted into the tub/shower valves 290. The shower head pipes 300 and tub head pipes 310 are then soldered into the tub/shower valve assemblies in accordance with common practices in the art. Once assembly is complete, the tub/shower valve assemblies are removed from the template and may then be installed into their final locations in bathrooms as appropriate and common in the art.

Alternate Embodiments

Figures 14, 14A:
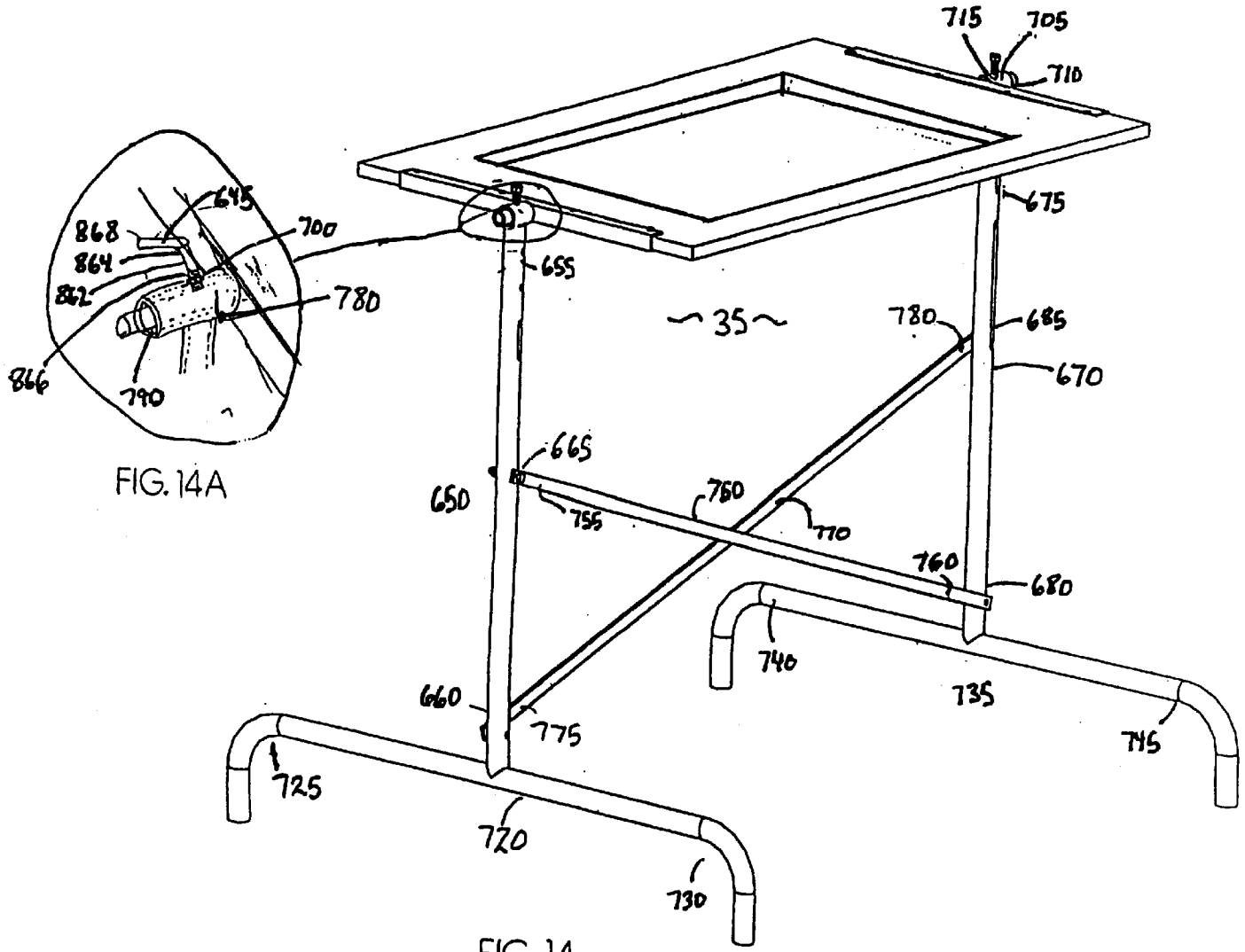
FIG. 14 is a perspective view of an alternate embodiment of the plumbing workstation with a single opening support template installed on the frame.
FIG. 14A is an exploded view of the alternate embodiment frame cylindrical collar and releaseable lock.
Figure 15:
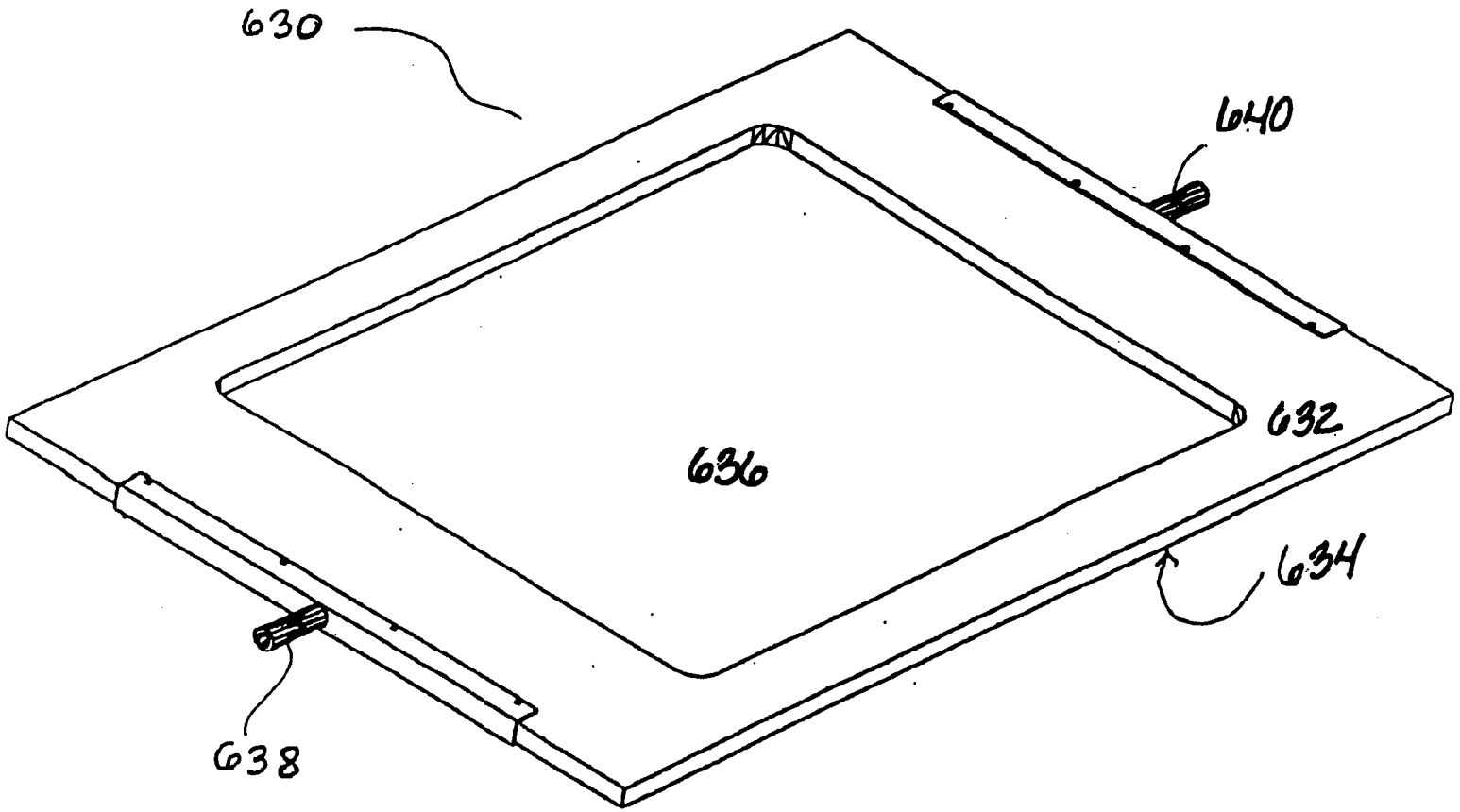
FIG. 15 is an alternate embodiment of a support template with a single opening.

FIGS. 14 through 17A show alternate embodiments at the present invention. Referring to FIG. 15 and FIG. 16, two alternate templates 630, 830 are shown. Template 630 includes a first stub shaft 638 and a second stub shaft 640. Alternate template 830, shown in FIG. 16, also includes a first stub shaft 855 and a second stub shaft 860. The stub shafts are carried on alternate frames 35, 900 as is discussed below.

The frame can be any configuration commonly known in the art suitable for receiving and supporting a template. By way of additional example, FIG. 14 depicts a frame 35 having a first vertical member 650, a second vertical member 670, a first horizontal member 720, a second horizontal member 735, a first cross-bar 750, and a second cross-bar 770. The first vertical member 650 has a top end 655 and a bottom end 660. The bottom end 660 is fixedly attached to the first horizontal member 720 intermediate of the first horizontal members first end 725 and second end 730. The second vertical member 670 has a top end 675 and a bottom end 680. The second vertical member's bottom end 680 is fixedly attached to the second horizontal member 735 intermediate of the second horizontal member's first end 740 and second end 745.

Figure 17:
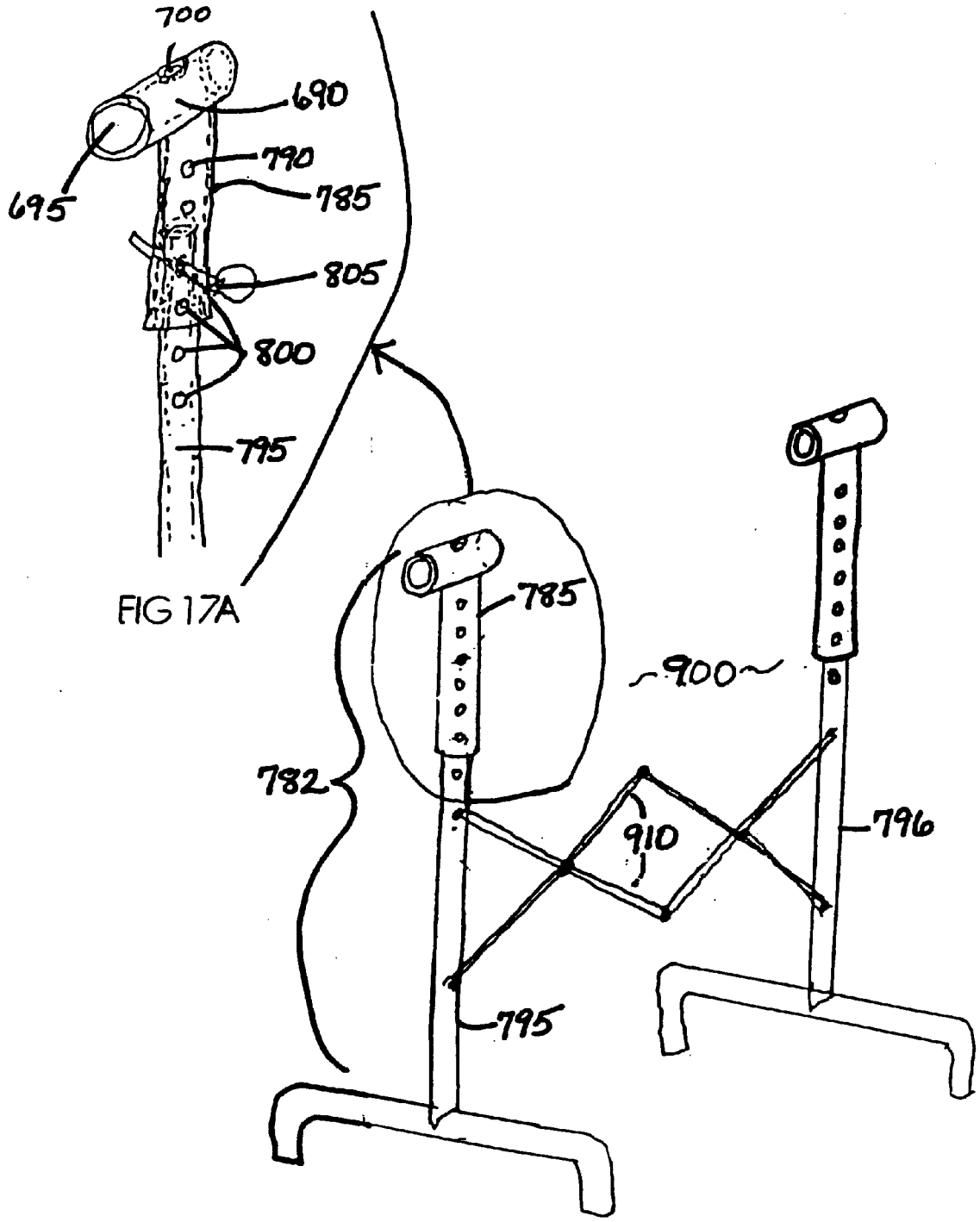
FIG. 17 is perspective view of an alternate embodiment of the frame which includes a height adjustment feature and a scissor cross support.

Additional cross-torsional stability for the frame 35 is provided by the first cross-bar 750 and second cross-bar 770. The first cross-bar 750 has a first end 755 and a second end 760. The second cross-bar 770 also has a first end 775 and a second end 780. The second cross-bar's first end 775 is attached to the first vertical member 650 in close proximity to the first vertical member/first horizontal member junction. The first cross-bar's second end 760 is attached to the second vertical member 670 in close proximity to the second vertical member/second horizontal member attachment point. The first cross-bar's first end 755 is releaseably attached to the first vertical member 650 at a point 665 above the first vertical member/second cross-bar attachment point. And, the second cross-bar's second end 780 is releaseably attached to the second vertical member 670 at a point 685 above the second vertical member/first cross-bar attachment. This vertical member and cross-bar arrangement allows the frame to be collapsed to facilitate storage and transport of the frame when the first cross-bar's first end 755 and the second cross-bar's second 780 are detached from the first vertical member 650 and second vertical member 670 respectively. Referring to FIG. 17, in an alternative embodiment of the frame 900, the collapsible feature can be achieved by replacing the cross-bar configuration of FIG. 14 with a collapsible scissor-support arrangement 910 mounted between the first member 795 and the second member 796.

Referring to FIG. 14 and FIG. 14A, fixedly attached to the top end 655 of the first vertical member 650 is a first cylindrical collar 780. The first cylindrical collar defines a first opening 790 there through with a centerline that is perpendicular to both the first vertical member 650 and the first horizontal member 720. The first cylindrical collar 780 further includes a second threaded opening 700 with a centerline perpendicular to the centerline of the first opening 790. The second opening 700 is suitable for receiving a releasable lock 645. The first cylindrical collar 780 pivotally carries the template 630, 830 first stub shaft 638, 855, respectively.

A second cylindrical collar 705 defining a first opening 710 is fixedly attached to the top end 675 of the second vertical member 670. The centerline of the first opening 710 is perpendicular to both the second vertical member 670 and the second horizontal member 735. The second cylindrical collar also includes a second opening 715 that is threaded and suitable for receiving a releasable lock. The second cylindrical collar 705 pivotally carries template 630, 830 second stub shaft 640, 860, respectively.

The centerline of the first cylindrical collar first opening 790 together with the centerline of the second cylindrical collar first opening 710 form the horizontal axis about which the template 630, 830 rotates. More specifically, the template stub shafts are pivotally carried in the first and second cylindrical collars allowing the template to be rotatable about the horizontal axis. The rotatability feature of the present invention can be accomplished any other manner common in the art. By way of example only and without intent to limit the scope of the present invention, rotation of the template about the horizontal axis could be accomplished via a ball and socket arrangement wherein balls would be mounted on the end of the stub shafts or simply replace the stub shafts and sockets would replace the cylindrical collars. The sockets would pivotally carry the balls thereby allowing the template to be rotatable around the horizontal axis. In a third alternative, the cylindrical collars could be replaced with chuck mechanisms that lock around the stub shafts but still allow the template to rotate about the horizontal axis. The quick release feature common to today's chucks would allow for quick interchangeability of templates.

Referring to FIG. 16 and FIG. 16A, an alternate embodiment of the sink retainer is shown. Sinks are secured into the template by sink retainer 810 having a top side 815 and a bottom side 820. As shown in FIG. 16A, protective cushion 825 is fixed on the bottom side 820. In use, the bottom side 820 with the protective cushion 825 is contacted against the sink and the sink retainer 810 is then secured in any conventional means to the template thereby trapping the sink in the template such that when the template is rotated about the horizontal axis, the sink will be retained in the template. The protective cushion 825 protects the sink from scratches and can be made from any suitable material such as rubber, foam, foam rubber, fiber, plastic, Teflon, air or liquid filled bladder and any combination thereof.

As shown in FIG. 14A, the releasable lock 645 comprises a first shaft 862 with a top end 864. Opposite the top end 864, is a threaded end 866 suitable for screwing into the first cylindrical collar's second threaded opening 700. A first handle 868 is fixedly attached to the top end 864. In operation, the releasable lock 645 is screwed into the second threaded opening 700 and against the first stub shaft 638, 855 thereby securing the template 630, 830 at a selected angular position about the horizontal axis. Unscrewing the releasable lock 645 removes pressure from the sink support template stub shaft 638, 855 and allows the template 630, 830 to be rotated about the horizontal axis. The releasable lock can be used at the first cylindrical collar 780, the second cylindrical collar 705 or both. When the releasable lock is used at the second cylindrical collar 705, a second shaft with a threaded end and a second handle fixedly attached to the top end of the second shaft is screwed into the second cylindrical collars second threaded opening 715 and against the template's 630, 830 second stub shaft 640, 860, thereby locking the template at a selected angular position about the horizontal axis.

FIG. 17 and FIG. 17A shows another alternate embodiment of the frame 900 that allows the vertical position of the horizontal axis to be adjusted by a worker to a comfortable height. In this alternate embodiment of the frame, the first vertical member 782 comprises a hollow tube top end 785 with a plurality of openings 790 there through with centerlines perpendicular to the centerline of the first cylindrical collar's first opening 695. The bottom end 795 of first vertical member 782 is a second hollow tube containing more than one opening 800 with centerlines perpendicular to the centerline of the first cylindrical collar's first opening 695. The internal diameter of the hollow tube top end 785 is greater than the external diameter of the bottom end hollow tube 795, which allows the top end 785 to slide over the bottom end 795 such that when any of the top end's plurality of openings 790 is aligned with the bottom end's more than one opening 800, a push pin 805 may be inserted through the top end and the bottom end to set the vertical height of the first cylindrical collar 780.

As can be readily seen, the present invention eliminates the problems associated with the traditional method of installing sinks and tub/shower valves. A worker is no longer required to crawl under a counter and assume an awkward and muscle straining position to install plumbing fixtures on sinks. Thus, the plumbing workstation is especially effective in eliminating muscle strains and corresponding lost time incidents associated with back strain occurring on jobs where many sinks must be installed. Further, the time to install a sink and tub/shower valve assembly can be drastically reduced. This cost savings becomes particularly significant on multi-unit plumbing jobs as in the case of apartment buildings and hotels.

Although other advantages may be found and realized and various modifications may be suggested by those versed in the art, it is understood that the present invention is not to be limited to the details given above, but rather may be modified within the scope of the appended claims.

I claim:

1. A tub/shower valve assembly workstation for use by a worker, comprising:

a. a frame;

b. means for temporarily supporting at least one tub/shower valve assembly, the supporting means being carried on the frame for 360° rotation about a horizontal axis; and c. means for locking the supporting means relative to the frame at selected angular positions about the horizontal axis.

2. The tub/shower valve assembly workstation of claim 1, wherein the frame includes means for vertically adjusting the position of the horizontal axis so that the horizontal axis can be adjusted by the worker to a height which is a comfortable working position for the worker to install plumbing fixtures.

3. The tub/shower valve assembly workstation of the claim 1, wherein the frame includes means for collapsing the frame thereby allowing the plumbing workstation to be easily transported and stored.

4. A tub/shower valve assembly workstation for assembling at least one tub/shower valve assembly, comprising:

a. a frame;

b. a template being pivotally carried on the frame for 360° rotation about a horizontal axis, the template having a top side, a bottom side, a first edge, a second edge opposite and parallel to the first edge, a third edge, a fourth edge opposite and parallel to the third edge, the third and fourth edges perpendicular to the first and second edges, a first bar mounted on the top side, the first bar in close proximity and parallel to the first edge, a second bar adjustably mounted on the top side, the second bar in close proximity and parallel to the second edge, the second bar having one or more grooves, a third bar mounted on the top side, the third bar parallel to and intermediate of the first bar and second bar, at lease one means for retaining at least one tub/shower valve, the at least one tub/shower valve retaining means being adjustably mounted on the first bar and the third bar such that when the at lease one tub/shower valve is mounted in the at least one tub/shower valve retaining means and at least one shower head pipe is inserted into the at least one or more tub/shower valve, the at least one shower head pipe end opposite the at least one tub shower valve is supported by the second bar and rests in the groove opposite and perpendicular of the at least one tub/shower valve whereby when the template is mounted on the frame the worker can use the tub/shower valve assembly workstation to assemble the at least one tub/shower valve assembly for subsequent installation into a bathroom; and c. a releasable lock for locking the template relative to the frame at selected angular positions about the horizontal axis, the releasable lock being adjustably mounted on the frame.

5. The tub/shower valve assembly plumbing workstation of claim 4, wherein the frame comprises:

a. an H-member having a first vertical tube, the first vertical tube having a proximal end and a distal end, the proximal end having at least two holes there-through, the at least two holes having center lines perpendicular to the first vertical tube and parallel to the horizontal axis, the distal end having at least one hole there-through, the H-member having a second vertical tube, the second vertical tube having a proximal end and a distal end, the proximal end having at least two holes there-through, the at least two holes having center lines perpendicular to the second vertical tube and parallel to the horizontal axis, the distal end having at least one hole there-through, the H-member having a horizontal tube with a first end and a second end, the first end fixedly attached to the first vertical tube intermediate of the first vertical tubes proximal and distal ends, the second end fixedly attached to the second vertical tube intermediate of the second vertical tubes proximal and distal ends;

b. a first foot member having a horizontal member and a vertical member, the horizontal member having a first end and a second end, the vertical member fixedly attached to the horizontal member intermediate of the horizontal member first and second ends, the vertical member extending upwardly and perpendicularly from the horizontal member, the vertical member having at least one hole there-through, the vertical member constructed to slide into the distal end of the H-member's first vertical tube, wherein when the vertical member's at least one hole and the first vertical tube distal end's at least one hole are aligned a pin is inserted there-through, thereby locking together the first vertical tube and the vertical member such that the first foot member's horizontal member is perpendicular to the horizontal axis;

c. a second foot member having a horizontal member and a vertical member, the horizontal member having a first end and a second end, the vertical member fixedly attached to the horizontal member intermediate of the horizontal member's first and second ends, the vertical member extending upwardly and perpendicularly from the horizontal member, the vertical member having at least one hole there-through, the vertical member constructed to slide into the distal end of the H-member's second vertical tube wherein when the vertical member's at least one hole and the second vertical tube's distal end at least one hole are aligned a pin is inserted there-through thereby locking together the second vertical tube and the vertical member such that the horizontal member is perpendicular to the horizontal axis;

d. a template support having a top side, a bottom side, a first edge, a second edge, a third edge and a fourth edge, the first edge is opposite and parallel to the second edge, the third edge is opposite and parallel to the fourth edge, the third and fourth edges perpendicular to the first and second edges, the third edge pivotally attached at its midpoint to the first vertical tube's proximal end, the fourth edge pivotally attached at its midpoint to the second vertical tubes proximal end;

e. an arc plate fixedly attached and horizontally centered on the template support's fourth edge, the arc plate comprising a shaped plate with a larger half circle extending downwardly from the fourth edge and a smaller half circle extending upwardly from the fourth edge, the larger half-circle having more than one hole arranged along its circumference, the smaller half-circle having more than one hole arranged along its circumference, such that when any of the more than one holes on the larger or small half circles are aligned with the second vertical tube's proximal end at least two holes, a pin may be inserted there-through thereby locking the template support in a specific angular position about the horizontal axis.

6. The tub/shower valve assembly workstation of claim 4, wherein the frame comprises:

a. a first vertical member with a top end and a bottom end said bottom end including at least one opening there-through, the at least one opening having a centerline perpendicular to both the first vertical member and the horizontal axis;

b. a second vertical member with a top end and a bottom end, said bottom end of the second vertical member including at least one opening there-through, the at least one opening of the second vertical member bottom end having a centerline perpendicular to both the second vertical member and the horizontal axis, whereby the radial and vertical location of said second vertical member bottom end's at least one opening is relationally identical to the radial and vertical location of said first vertical member bottom end's at least one opening;

c. a first cylindrical collar fixedly attached to the top end of the first vertical member, the first cylindrical collar defining a first opening there-through suitable for pivotally attaching to the template, said first opening having a centerline that is perpendicular to both the first vertical member and the centerline of the at least one opening of the first vertical member, the first cylindrical collar further including a second smaller threaded opening with a centerline perpendicular to the centerline of the first opening, whereby the second smaller threaded opening is suitable for receiving the releasable lock;

d. a second cylindrical collar fixedly attached to the top end of the second vertical member, the second cylindrical collar defining a first opening there-through suitable for pivotally attaching the template, said first opening having a centerline that is perpendicular to both the second vertical member and the centerline of the at least one opening of the second vertical member, the second cylindrical collar further including a second smaller threaded opening with a centerline perpendicular to the centerline of the first opening, whereby the centerline of the second cylindrical collar's first opening and the centerline of the first cylindrical collar's first opening together define the horizontal axis, the second cylindrical collar's second smaller threaded opening is suitable for receiving the releasable lock;

e. a first horizontal member with a first end and a second end, the first horizontal member being fixedly attached to the bottom end of the first vertical member intermediate of the first horizontal member's first end and second end and perpendicular to the horizontal axis;

f. a second horizontal member with a first end and a second end, the second horizontal member being fixedly attached to the bottom end of the second vertical member intermediate of the second horizontal member's first end and second end and perpendicular to the horizontal axis.

g. a first cross bar with a first end and a second end, the first end being removably attached to the first vertical member bottom end at the first vertical member's at least one opening, the second end being fixedly attached to the bottom end of the second vertical member in close proximity to the attachment at the second vertical member and second horizontal member;

h. a second cross bar with a first end and a second end, the first end being fixedly attached to the first vertical member bottom end in close proximity to the attachment of the first vertical member and first horizontal member and the second end being removably attached to the second vertical member bottom end at the second vertical member's at least one opening, such that when the second cross bar second end and first cross bar first end are unattached and the frame is not carrying the template, the frame may be collapsed to facilitate transport and storage.

7. The tub/shower valve assembly workstation of claim 6, wherein the top end of the first vertical member is a hollow tube with a plurality of openings there-through, said plurality of openings with center lines perpendicular to the first cylindrical collars first opening, and the bottom end of the first vertical member comprising a second hollow tube wherein the internal diameter of the top end is greater than the external diameter of the bottom end allowing the top end to slide over the bottom end such that when any of the top end's plurality of openings is aligned with the bottom end's at least one opening, a push pin may be inserted into the aligned top end and bottom end openings to set the vertical height of the first cylindrical collar.

8. The tub/shower valve assembly workstation of claim 7, wherein the top end of the second vertical member is a hollow tube with a plurality of openings there-through, said plurality of openings with center lines perpendicular to the second cylindrical collar's first opening, and the bottom end of the second vertical member comprising a second hollow tube wherein the internal diameter of the second vertical member's top end is greater than the external diameter of the second vertical member's bottom end allowing said top end to slide over the bottom end such that when any of the top end plurality of openings is aligned with the bottom end's at least one opening, a push pin may be inserted into the aligned top end and bottom end openings to set the vertical height of the second cylindrical collar, such that the vertical height of the horizontal axis can be adjusted by setting the first cylindrical collar and second cylindrical collar at the same height.

9. The tub/shower valve assembly workstation of claim 6, wherein the template further comprises a first stub shaft pivotally carried by the first cylindrical collar and a second stub shaft pivotally carried by the second cylindrical collar for allowing the template to be rotated about the horizontal axis.

10. The tub/shower valve assembly workstation of claim 9, wherein the releasable lock comprises:

a. a first shaft with a top end and a threaded end opposite said top end, said threaded end suitable for screwing into the first cylindrical collar's second threaded smaller opening;

b. a first handle fixedly attached to the top end of the first shaft such that a worker can easily screw the first shaft's threaded end into the first cylindrical collar's second threaded smaller opening and against the first stub shaft thereby allowing the worker to lock the sink support template at any rotational location.

11. The tub/shower valve assembly workstation of claim 10, wherein the releasable lock further comprises:

a. a second shaft with a top end and a threaded end opposite said top end, said threaded end suitable for screwing into the second cylindrical collar's second threaded smaller opening;

b. a second handle fixedly attached to the top end of the second shaft such that a worker can easily screw the second shaft's threaded end into the second cylindrical collar's second smaller threaded opening and against the second stub shaft thereby allowing the worker to lock the sink support template into any rotational location.

12. A method of using a tub/shower valve assembly workstation to assemble at least one tub/shower valve assembly, comprising the steps;

a. choosing a template such that the template chosen is suitable for assembling at least one tub/shower valve assembly;

b. installing the template onto a frame, the template being carried on the frames for 360° rotation about a horizontal axis;

c. locking the template into a horizontal position on the frame;

d. mounting at least one tub/shower valve onto the template;

e. inserting at least one shower head pipe into the at least one tub/shower valve;

f. inserting at least one tub head pipe into the at least one or more tub/shower valve;

g. soldering the at least one shower head pipe and the at least one tub head pipes into the at least one tub/shower valve; and h. removing the at least one tub/shower valve assembly from the template.

* * * * *